United States Patent [19]

Kopper

[11] Patent Number: 4,993,246

[45] Date of Patent: Feb. 19, 1991

[54] EXPANSION PLUG WITH LOCKABLE LEVER

[75] Inventor: Jan Kopper, Marco Island, Fla.

[73] Assignee: Shaw Aero Development, Inc., Naples, Fla.

[21] Appl. No.: 490,342

[22] Filed: Mar. 8, 1990

[51] Int. Cl.[5] ..... B65D 55/14

[52] U.S. Cl. ..... 70/166; 292/240

[58] Field of Search ..... 292/240, 241; 220/235, 220/238; 70/163–173

[56] References Cited

U.S. PATENT DOCUMENTS

| | | | |
|---|---|---|---|
| 2,604,225 | 7/1952 | Armstrong | 220/238 |
| 2,822,108 | 2/1958 | Moeller | 220/238 |
| 3,087,641 | 4/1963 | Millard | 220/238 |
| 3,295,712 | 1/1967 | Peterson | 220/235 |

*Primary Examiner*—Robert L. Wolfe

*Attorney, Agent, or Firm*—Cushman, Darby & Cushman

[57] ABSTRACT

An expansion plug including a cam lever with a securing portion, and a top plate with a flange. A first hole is centered in the securing portion and a second hole is centered in the flange. During engagement of the cam lever, the securing portion adjoins the flange, aligning the two holes. Thus, a lock may be inserted through both holes to securely fasten the cam lever to the top plate.

4 Claims, 1 Drawing Sheet

FIG. 1
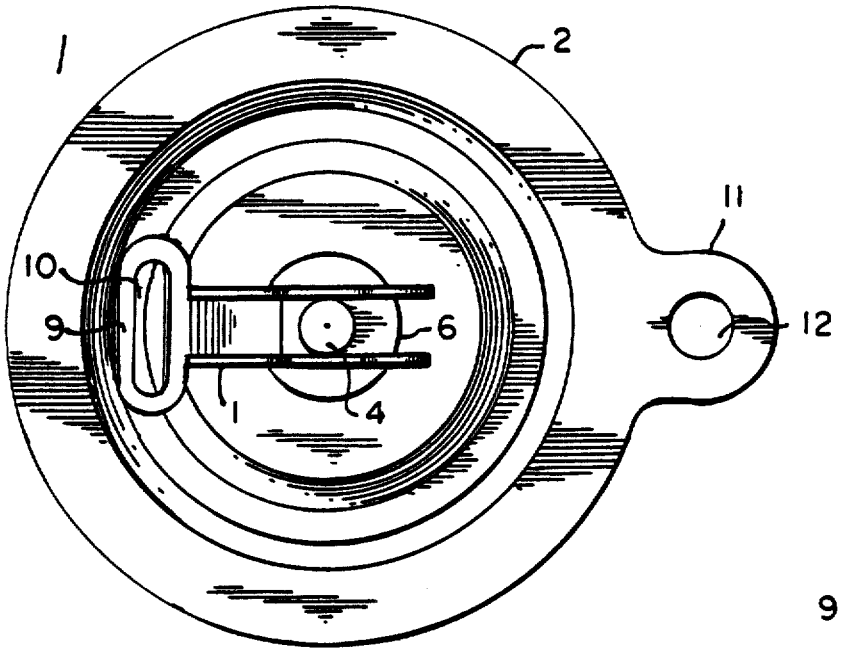
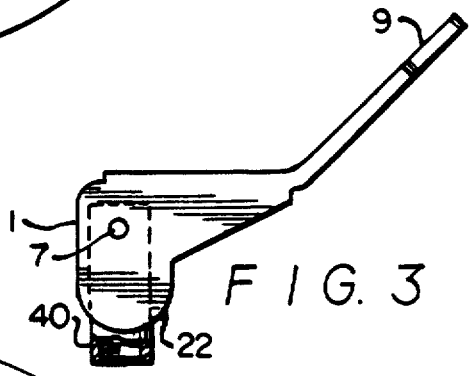
FIG. 3
FIG. 2
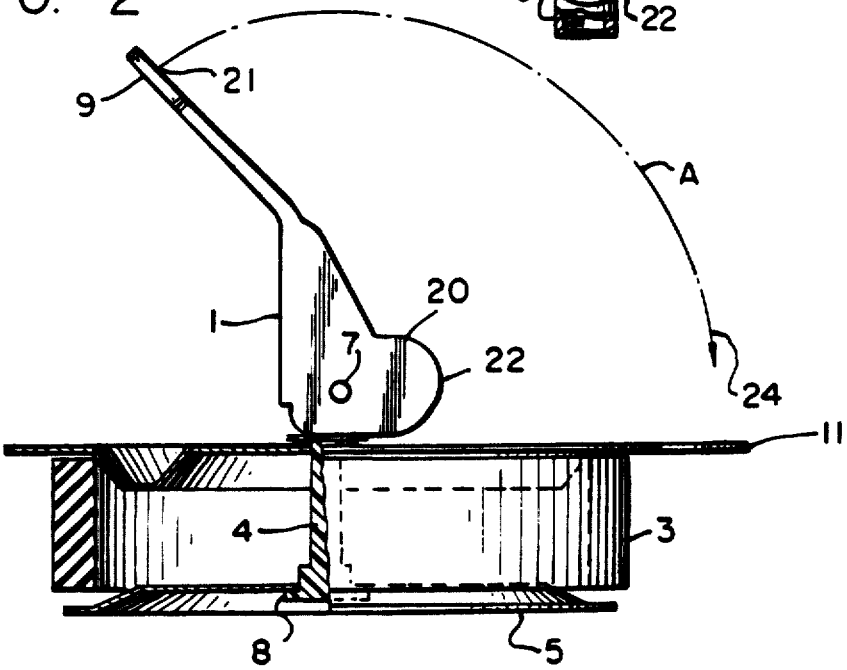

EXPANSION PLUG WITH LOCKABLE LEVER

BACKGROUND OF THE INVENTION

1. Field of the Invention

The present invention relates to a cam lever operated expansion plug, and more particularly, to a cam lever expansion plug which can be locked by fastening the cam lever.

2. Background and Related Art

A typical expansion plug comprises an expandable rubber stopper, and some type of means for expanding the rubber stopper, which operates as the opening and closing apparatus. To operate the expansion plug, the closing apparatus is activated to compress the rubber stopper which expands radially to plug and seal an opening.

U.S. Pat. No. 2,292,149 to Moeller discloses a typical expansion plug having a cam lever closing apparatus. U.S. Pat. No. 2,773,619, also to Moeller, discloses a typical expansion plug having a screw-type handle closing apparatus.

Expansion plugs were later adapted to provide adjustability and to prevent accidental tampering or removal. U.S. Pat. No. 2,822,103 to Moeller describes a cam lever operated plug having a lever locking means which prevents the lever from accidental rotational when in the engaged location. U.S. Pat. No. 2,822,108 to Moeller discloses a plug having an adjustable lock wherein a lock plate holds the plug in a predetermined set position irrespective of the movement of a cam lever. Thus, the cam lever may be rotated without affecting the seal. U.S. Pat. No. 3,295,712 to Peterson describes an adjustable and improved safety plug having a ribbed stem. A U-shaped locking plate may be inserted between the ribs of the stem to maintain a desired seal even if the closing apparatus is accidentally released.

Expansion plugs have proved excellent closure mechanisms due to their air-tight closure characteristics. However, as applications requiring more security have arisen, for example in fuel tanks of aircraft, expansion plugs have been less frequently used. The inventors of the present invention have recognized a need to fasten the expansion plugs in a tamperproof way in order to prevent removal. Moreover, the inventors have recognized a fairly simple and straightforward manner of doing this.

The prior art has never devised a quality means for making the device tamper proof. Although the prior art teaches means for preventing a cam lever from rotating, and means for preventing accidental release, the teachings only go to preventing accidental rotation or release. Deliberate attempts to remove a plug would almost always be successful when using the prior art structure, as they are designed to allow manual release, so that access to the plugged area could be obtained. Thus, conventional expansion plugs tend not to prevent deliberate tampering, for example, theft of gasoline, or terrorist activities by tampering with the gasoline.

SUMMARY OF THE INVENTION

The object of the present invention is to provide an improved expansion plug which includes means for locking the plug in its closed position to prevent deliberate tampering and theft.

To achieve this object, the preferred embodiment defines a cam lever having a securing portion and a top plate having a flange. Both the securing portion and the flange have a hole centered therein. When the cam lever is engaged, the hole in the securing portion aligns with the hole in the flange, thereby accommodating a locking means which securely fastens the securing portion to the flange. Thus, the cam lever may not be opened by deliberate or incidental tampering.

BRIEF DESCRIPTION OF THE DRAWING

These and other advantages will become more apparent from the detailed description of the preferred embodiment along with the following drawings:

FIG. 1 is a top perspective of the present invention;

FIG. 2 is a side perspective of a first embodiment of the present invention; and FIGURE 3 is a side perspective of a cam lever/stem assembly according to a second embodiment of the present invention.

DESCRIPTION OF THE PREFERRED EMBODIMENT

FIGS. 1–3 show an expansion plug according to the present invention. The expansion plug comprises cam lever 1, top plate 2, rubber stopper 3, stem 4, bottom plate 5, and washer 6. Cam lever 1 is used to open and close the expansion plug, by expanding and contracting stopper 3. Cam lever 1 hinges around pin 7 to move in the direction shown by arrow A.

In a first preferred embodiment shown in FIG. 2, cam lever 1 is pinned directly via pin 7 to stem 4 in a non-adjustable manner. Some conventional expansion plugs employ adjustable cam lever/stem assemblies. These assemblies do not generally withstand deliberate tampering because one may easily circumvent any tamperproof feature by adjusting the device so loosely that the plug may be forced open. However, attaching cam lever 1 directly to stem 4, albeit non-adjustable, prevents deliberate, forcible detachment of the plug via the cam lever/stem assembly.

Flange 8 of stem 4 prevents stem 4 from pulling through bottom plate 5. Stem 4 may also be physically attached to bottom plate 5.

In a second preferred embodiment shown in FIG. 3, cam lever 1 is pinned via pin 7 to threaded stem 40 which permits cam lever 1 to be adjusted.

Cam lever 1 is positioned above top plate 2 and includes an irregular shaped cam area 20, and securing portion 9, which has hole 10 centered therein. Top plate 2 is of a substantially disk shape with a flange 11, which has hole 12 centered therein.

In operation, cam lever 1 begins in disengaged position 2. In this position, the extending portion 22 of cam portion 20 is disengaged. Once placed in a desired opening, cam lever 1 is folded over to engaged position 24. As a result, stem 4 and bottom plate 5 are drawn toward top plate 2, thereby compressing rubber stopper 3, which expands radially to seal the opening.

After cam lever 1 is fully engaged, securing portion 9 of cam lever 1 adjoins flange 11 of top plate 2, in a way such that hole 10 of securing portion 9 is aligned with hole 12 of flange 11. Once the holes are aligned, the cam lever may be latched into its closed position by placing a lock, such as a padlock, through holes 10 and 12 so that cam lever 1 is attached to top plate 2. Accordingly, the present invention prevents any deliberate or incidental tampering, since the expansion plug may be removed only after the lock is unfastened.

It is to be understood that the invention is not limited to the disclosed embodiment, but is intended to cover various modifications and equivalent arrangements included within the spirit and scope of the appended claims.

I claim:

1. An expansion plug comprising:

a bottom plate;

a top plate having a flange with a first hole therein;

a rubber stopper disposed between said bottom and top plates for expanding radially when compressed between said bottom and top plates;

a stem connected to said bottom plate and extending centrally through said rubber stopper and said top plate; and cam lever means, including a pin connecting said cam lever means to said stem in a non-adjustable manner above said top plate, for drawing said stem and said bottom plate toward said top plate during engagement, thereby expanding radially said rubber stopper, said cam lever means having a securing portion with a second hole therein;

wherein when said cam lever means is fully engaged, said securing portion is adjacent to said flange, thereby aligning said second hole in said securing portion with said first hole in said flange.

2. An expansion plug according to claim 1 further comprising washer means disposed around said stem between said top plate and said cam lever means.

3. An expansion plug comprising:

a bottom plate;

a top plate having a portion with inner surfaces defining a first hole therein;

a rubber stopper disposed between said bottom and top plates for expanding radially when compressed between said bottom and top plates; and means for compressing said rubber stopper between said bottom plate and said top plate, having a lever portion formed with inner surfaces defining a second hole therein and including a pin connecting said lever to said compressing means in a non-adjustable manner so that said;

wherein when said compressing means is fully engaged, said securing portion is adjacent to said flange, thereby aligning said second hole in said compressing means with said first hole in said portion of said top plate.

4. An lockable expansion plug assembly comprising:

a bottom plate;

a substantially flat and disk shaped top plate including a portion coupled thereto, with inner surfaces defining a first hole therein;

a substantially cylindrical shaped rubber stopper disposed between said bottom and top plates for expanding radially when compressed between said bottom and top plates;

means for compressing said rubber stopper between said bottom plate and said top plate, having a first surface which is irregular in shape such that it does not compress said rubber stopper when it is in a first position and does compress said rubber stopper when it is in a second position, and a second surface, used to change between said first and second positions, said second surface formed with inner surfaces defining a second hole therein, and said second position being a position where said first and second holes are adjacent one another including means for connecting said compressing means to said top plate means in a non-adjustable manner.

* * * * *